United States Patent [19]

Babington

[11] Patent Number: 4,457,287

[45] Date of Patent: Jul. 3, 1984

[54] ARCHERY BOW ASSEMBLY HAVING UNIVERSALLY MOUNTED HANDLE

[76] Inventor: Charles E. Babington, 1916 Shire Ct., Dayton, Ohio 45414

[21] Appl. No.: 343,004

[22] Filed: Jan. 26, 1982

[51] Int. Cl.[3] ..... F41B 5/00

[52] U.S. Cl. ..... 124/23 R; 124/88

[58] Field of Search ..... 124/23 R, 24 R, 80, 124/1, 41 B, 86, 88

[56] References Cited

U.S. PATENT DOCUMENTS

| | | | |
|---|---|---|---|
| 2,854,965 | 10/1958 | Eberbach | 124/24 R X |
| 2,957,469 | 10/1960 | Wilkerson | 124/24 R |
| 3,171,397 | 3/1965 | Daly | 124/24 |
| 3,397,685 | 8/1968 | Walker | 124/24 |
| 3,407,799 | 10/1968 | Reynolds | 124/24 |
| 3,416,508 | 12/1968 | Thompson | 124/88 X |
| 3,513,820 | 5/1970 | Thompson | 124/23 R |
| 3,517,658 | 6/1970 | Shurts | 124/23 R |
| 3,538,902 | 9/1967 | Fowkes | 124/23 R X |
| 3,599,621 | 8/1971 | Scrobell | 124/23 |
| 3,812,834 | 5/1974 | Saunders | 124/20 R |
| 3,865,094 | 2/1975 | Sweeney | 124/20 R |
| 3,875,923 | 4/1975 | Horel | 124/20 R |
| 3,901,209 | 8/1975 | Woolsey et al. | 124/20 R |
| 3,923,035 | 12/1975 | Trotter | 124/86 |

*Primary Examiner*—Richard J. Apley
*Assistant Examiner*—William R. Browne
*Attorney, Agent, or Firm*—Dybvig & Dybvig

[57] ABSTRACT

An archery bow assembly includes a bow, a hand grip, and a ball and socket joint establishing a universal connection between the hand grip and the bow. The ball and socket joint is mounted on the bow by a piston movable in a cylindrical cavity formed in a mounting block mounted to the bow. A bias spring acting on the piston causes key and slot members to firmly interfit with one another to prevent relative movement of the hand grip and the bow. The key and slot members are moved apart when the bow string is drawn to permit limited universal movement of the ball relative to the socket and, accordingly, the hand grip relative to the bow. Hydraulic fluid within the cavity and a valve associated with the piston dampen the return movement of the hand grip after the arrow is released. The location of the hand grip is adjustable in two dimensions to adapt to the style of grip of the archer.

25 Claims, 6 Drawing Figures

144
114
12
118
146
10
112
114
146
116
120
128
110
111
123
124
116
130
126
122
129
96
90
82
88
89
100
98
110
84
94
76
92
86
62
64
84A
74
68
48
46
44
50
132
70
74
66
48
50
42
51
136
53
138
40
49
135
54
137
142
72
52
132
58
56
60
134

ARCHERY BOW ASSEMBLY HAVING UNIVERSALLY MOUNTED HANDLE

SUMMARY OF THE INVENTION

In the present invention, a hand grip is attached to an archery bow through the medium of a hand grip attachment assembly including a ball and socket joint and a piston and cylinder type dampener assembly interposed between the ball and socket joint and the bow. Except when an arrow is fired, the freedom of universal movement ordinarily afforded by the ball and socket joint is restricted by means of interfitting key and slot elements biased together by a spring acting on the piston. When the bow string is tightened to shoot an arrow, with the archer's hand holding the hand grip, the bow is effectively pulled away from the hand grip and the interfit between said key and slot elements is released.

This release of the key and slot elements frees the ball and socket joint for a limited universal movement, thus allowing the archer to take an adjusted aim of his arrow. Upon discharge of the arrow, the piston and cylinder type dampener initially resists any movement of the bow relative to the hand grip and the archer's hand but, as the arrow is discharged, a restricted hydraulic bypass associated with the piston and cylinder-type dampener allows the spring acting on the piston to reset the key and slot elements in a controlled but short time interval to again immobilize the ball and socket joint.

In the preferred embodiment, the hand grip assembly includes means for adjustment of the ball and socket joint longitudinally of the hand grip for accommodating grip variations such as high grip and low grip, and includes means for adjusting the grip assembly as a whole longitudinally of the bow so as to place the arrow in an optimum flight path regardless of the aforementioned ball and socket joint adjustment.

DETAILED DESCRIPTION

Figure 1:
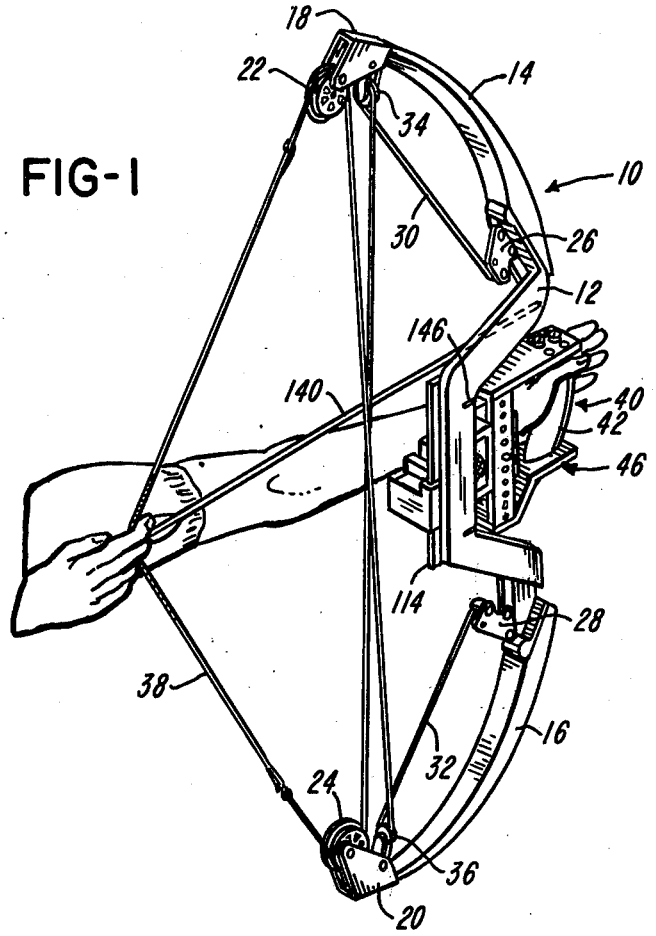
FIG. 1 is an isometric illustration of a bow assembly in accordance with the present invention, this Figure illustrating the hands of an archer aiming an arrow.

The drawings illustrate utilization of the present invention in association with a compound bow 10 that is of a type commercially available. It is to be appreciated, however, that the present invention is applicable to recurve and other types of archery bows and is not restricted to compound bows or to the riser configuration and cable winding arrangement of the compound archery bow 10 illustrated in the drawings.

Referring to FIG. 1 in greater detail, the compound bow 10 comprises a cast, essentially rigid, handle riser 12 to opposite ends of which have been bolted or otherwise affixed an upper limb 14 and a lower limb 16. The limbs 14 and 16 each comprise a resilient material such as reinforced plastic, wood or the like and have metallic tips 18 and 20 respectively, fitted to the free ends thereof. The tip 18 and 20 support respective eccentric pulleys 22 and 24.

Bolted or otherwise affixed to the opposite ends of the riser are respective brackets 26 and 28, sometimes called speed brackets, which project inwardly from the concave side of the compound bow 10. Referring to the upper speed bracket 26 there is anchored to that bracket a cable 30 looped about an idler 34 journaled to the tip 18. From the idler 34, the cable 30 crosses the bow to loop about the eccentic pulley 27 supported by the tip 20, the cable 30 then having its end firmly affixed to a conventional bow string 38.

Referring to the speed bracket 28, this bracket anchors a cable 32 looped about an idler 36 journaled to the tip 20 and extending from the idler 36 across the bow to the eccentric pulley 22 supported by the tip 18, where the cable 32 is firmly affixed to the opposite end of the bow string 38, the cables 30 and 32 tautly holding the bow string 38 between the eccentric pulleys 22 and 24.

Figure 2:
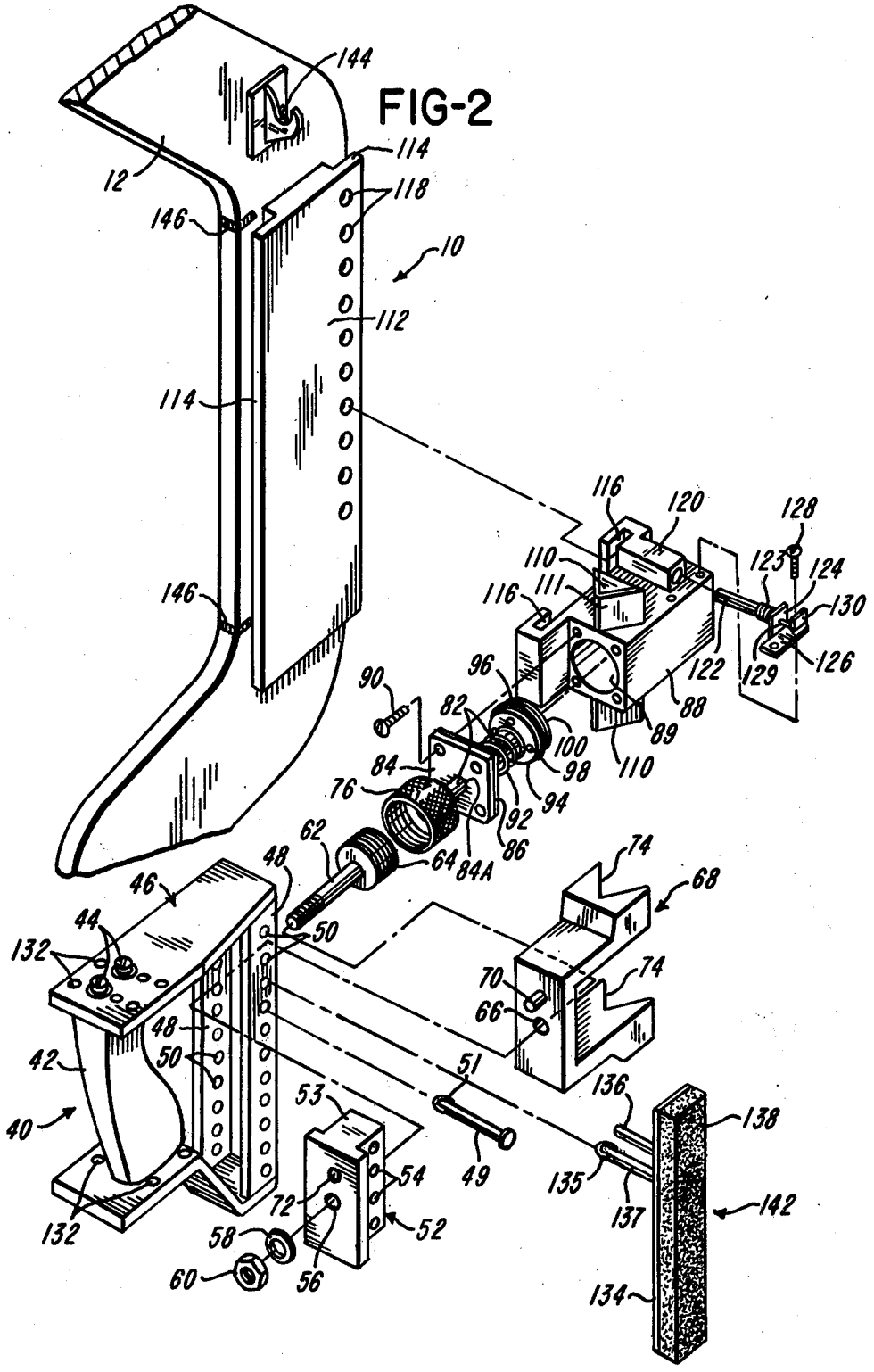
FIG. 2 is an enlarged illustration of a riser broken away from the bow of FIG. 1, FIG. 2 further illustrating in exploded detail a hand grip assembly mounted to the riser.
Figure 3:
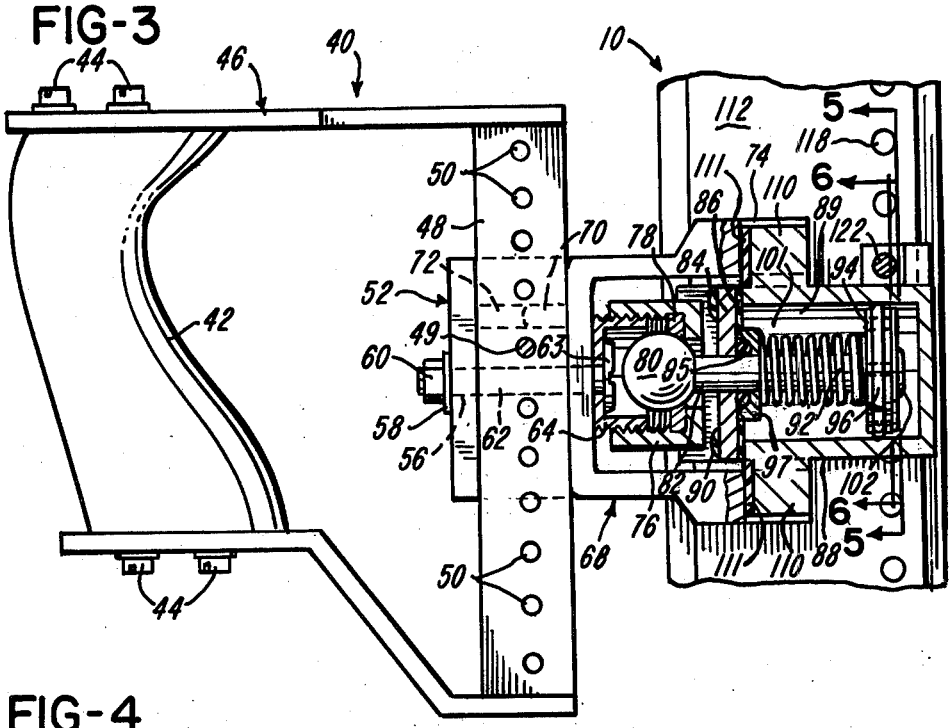
FIG. 3 is a fragmentary sectional illustration of the hand grip assembly mounted to the riser, this Figure depicting the hand grip assembly when not being stressed as if to aim an arrow.
Figure 4:
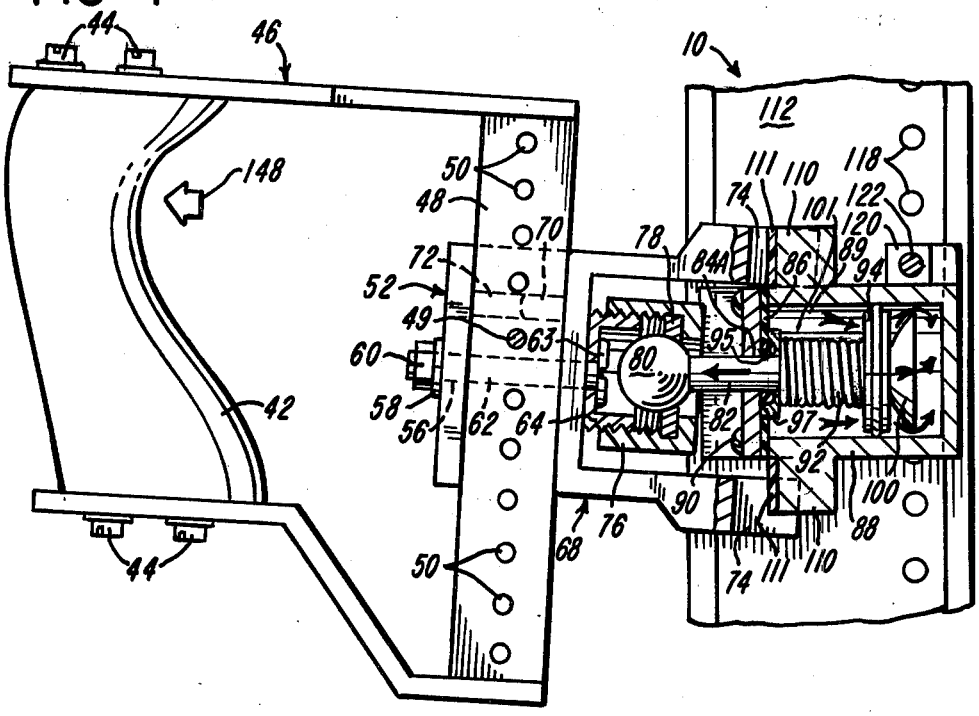
FIG. 4 is a fragmentary sectional illustration comparable to FIG. 3, this Figure depicting the hand grip assembly when stressed by the archer in aiming an arrow.

Adapted for attachment to the riser 12 as will be more fully explained is a hand grip assembly 40 including a hand grip 42, this hand grip assembly being illustrated in detail in FIGS. 2, 3 and 4. The hand grip assembly 40 includes a shaped grip 42 fastened by fasteners 44 within a frame 46. The frame 46 includes spaced apart side bars 48, each having a plurality of longitudinally spaced apertures 50 with the apertures 50 through one of said side bars being coaxially aligned with the apertures 50 through the other of said side bars.

The side bars 48 form an open channel extending parallel to the length of the grip 42 and such channel is sized to slidably receive a guide member 52. The guide member 52 which is generally T-shaped in cross-section has a plurality of apertures 54 spaced longitudinally along its leg 53, the arrangement being such that upon assembly of the leg 53 of the guide member 52 between the side bars 48, the guide member may be slid lengthwise along the open slot defined by the side bars 48 to selectively align guid member apertures 54 with side bar apertures 50 and thus locate the guide member longitudinally between the side bars 48. Such location is locked by means of a locking pin 49 having a pivotally attached keeper 51 and inserted through any pair of the aligned apertures 50 and 54.

Passing centrally through the body of the guide member 52 in a direction perpendicular to its length is an aperture or bore 56 sized to receive a headed hand grip mounting rod 62. The head 63 of the mounting rod 62 is received in a cylindrical, cup-like socket housing member 64 having a threaded outer wall.

The mounting rod 62 passes centrally through an aperture 66 disposed in the frame of a triangular slot member 68 having a forwardly projecting locator pin 70. The mounting rod 62 also passes through the aperture 56 in the guide member 52 to be engaged by a nut 60 confining a washer 58. The nut 60 is torqued to draw the head of the mounting rod 62 toward the nut 60 thus to securely position the socket member 64 and the slot member 68 in relation to the guide member 52.

As best seen in FIGS. 3 and 4, the guide member 52 has an aperture 72 extending through its legs 53 for receiving the locator pin 70, the consequence being that the slot member 68 is restrained against rotation about the axis of the mounting rod 62.

Caged within the socket housing member 64 with aid of a knurled, internally threaded housing sleeve 76 is a centrally apertured, circular socket plate 78 whose inner periphery is spherically curved to fit the outer surface of a ball element 80 which is confined within the housing formed by the housing socket member 64 and housing sleeve 76, the ball element 80 and the socket plate 78 comprising a ball and socket joint. Affixed to and extending from the ball element 80 is a piston rod 82. The piston rod 82 passes from the confined ball element 80 rearwardly through an aperture 84*a* located in the center of a cylinder cover plate 84. Lying adjacent the cover plate 84 is a gasket 86 which bears against a mounting or cylinder block 88 in surrounding relation to a cylindrical cavity 89 therein. Screws 90 passing through suitably located apertures in the cover plate 84 and in the gasket 86 threadedly engage in apertures in the mounting block to firmly compress the gasket 86 between the cover plate 84 and the mounting block 88 to provide a fluid tight seal between the cover plate 84 and the mounting block 88. A fluid tight seal is also provided between the piston rod 82 and the cover plate aperture 84*a* by an "O" ring sealing member 95 confined between the cover plate 84 and an "O" ring retaining plate 97 and bearing against both the piston rod 82 and the cover plate 84 a piston 94 is received for movement within the cavity 89 and includes a "O" ring bearing member 96 sized to fit snugly within the cavity 89. Interposed between the retaining plate 97 and the piston 94 is a return or bias spring 92 which surrounds the piston rod 92. The piston rod 82 passes through a central aperture in the piston 94 and the outermost end of the piston rod 82 is swaged or upset to form a head 102 to retain the piston 94 on the piston rod 82. It may be noted that the bias or return spring 92 biases the "O" ring retaining plate 97 to hold the "O" ring 95 in sealing relation to the piston rod 82 and the cover plate 84 and also biases the piston 94 against the head 102. Also, it may be noted that the longitudinal axis of the piston rod 82 is coextensive with the center axis of the cavity 89, the piston rod 82 being confined from movement along such axis by the piston 94 and the cover plate surfaces defining the aperture 84*a*.

The mounting or cylinder block 88 can be seen to be closed at its rightward or rearward end as viewed in FIG. 3. In operation, the mounting block 88 is filled with hydraulic fluid, such as oil, disposed in the portion of the cylinder chamber designated 101, not occupied by the piston parts, filling the chamber 101 to the exclusion of any gas bubbles or gas pockets.

Figure 5:
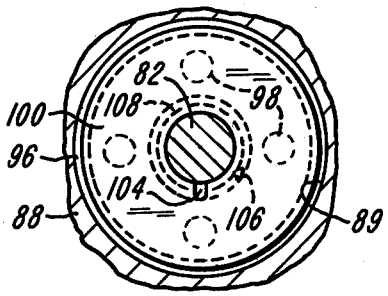
FIG. 5 is a fragmentary sectional illustration taken substantially along the line 5—5 of FIG. 3.

The piston 94 is afforded a freedom of movement relative to the cylinder or mounting block 88 by means of vents 98 which pass through the body of the piston. Confined adjacent the rightward face of the piston as it appears in FIG. 4, by means of the upset head 102 of the piston rod 82 is a flexible, plate-like annular valve or diaphragm 100 which is of substantially the same diameter as the piston 94. FIG. 5 is a section view so cut as to reveal the valve 100 fully along one face of that valve. When the piston rod 82 to driven to the left relative to the mounting block 88 as viewed in FIG. 4, as will be described below, the resulting pressure on the hydraulic fluid confined within the cylinder chamber 101 forces the valve 100 to lag the leftward movement of the piston rod as shown in FIG. 4. When the movement of the piston rod is reversed so that it is biased rightwardly as that direction appears in FIGS. 3 and 4,the incompressibility of the accumulated hydraulic fluid 101 then residing to the right of the valve 100 tends to block any rightward movement of the piston rod 82.

Figure 6:
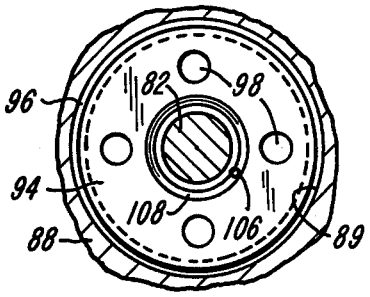
FIG. 6 is a fragmentary sectional illustration taken substantially along the line 6—6 of FIG. 3.

To nevertheless permit a relative rightward movement of the piston rod 82, the valve 100 is provided with a window 104 (FIG. 5) located adjacent the outside wall of the piston rod 82, a small aperture 106 (FIGS. 5 and 6) extends through the body of the piston 94 and the face of the piston 94 confronting the valve 100 is provided with an annular channel 108 that provides unrestricted movement of the hydraulic fluid from the window 104 to the channel 108, the aperture 106 and the channel 108 best appearing in FIG. 6.

The aperture 106 performs as a restricted bypass means to permit a slow rightward movement of the piston rod 82 relative to the mounting block 88. Thus, when the piston rod 82 is moved rightwardly, as will be described below, the valve 100 closes the vents 98 but the aperture 106, acting in combination with the window 104, allows a controllably small portion of the hydraulic fluid to pass through the piston 94, thus to allow the piston 94 to move rightwardly at a rate which will be controlled primarily by the size of the aperture 106 and the magnitude of the forces acting to move the piston rod 82 rightwardly as it appears in FIGS. 3 and 4. It may be observed that the vents 98 are sufficiently large that the hydraulic fluid will not substantially restrict relative leftward movement of the piston 94 as viewed in FIGS. 3 and 4. In contrast, relative movement of the piston 94 in the opposite direction is substantially impeded due to the small size of tbe aperture 106.

Formed integrally on or fixedly attached to the mounting block 88 are oppositely disposed triangular keys 110 covered by V-shaped yieldable snubbing sheets 111 sized to interfit triangular slots 74 formed in the slot member 68. Also formed integrally on or fixedly attached to the mounting block 88 are longitudinal groove portions 116 adapted to slidably receive longitudinally extending tongue portions 114 disposed on a slideway or gib 112 affixed to the riser 12 and extending longitudinally in the lengthwise direction of the compound bow 10.

The slideway 112 is provided with a plurality of longitudinally spaced apertures 118. Formed integrally on or fixedly attached to the mounting block 88 is a socket member 120 apertured to slidably receive a locking pin 122 capable of entering any of the slideway apertures 118. The pin 122 can thus be utilized to fix the longitudinal position of the triangular keys 110 with respect to the length of the compound bow. The end portion, designated 129, of the locking pin 122 remote from the slideway 112 has a reduced diameter and is slidably fitted in an apertured flange 124 integral with a mounting plate 126. A compression spring 123 is coiled about the reduced diameter end portion 129 and is trapped between the shoulder formed by the larger diameter portion of the locking pin 122 and the flange 124 so as to bias the pin 122 toward the slideway 112. This mounting plate is apertured to receive mounting screws 128 which threadedly engage in suitable apertures located in the mounting block 88. A flange 130 affixed to the rearward, free end of the reduced diameter pin portion 129 may be manually pulled to retract the locking pin 122 against the bias of the spring 123 and rotated so as to hook the mounting plate 126 and the mounting block 88, thus holding the locking pin 122 retracted from the slideway 112 for convenience in adjusting the longitudinal position of the mounting block 88 relative to the slideway 112.

Referring to the frame 46 for the hand grip 42, there are illustrated in FIG. 2 a plurality of pairs of apertures 132, the members of each pair being vertically spaced to receive threaded fasteners 44 which threadedly engage into suitably located apertures (not shown) in the body of the hand grip 42. The successive pairs of the apertures 132 can be seen to be spaced apart in a direction perpendicular to the longitudinal axis of the hand grip 42. Since the longitudinal axis of the hand grip is parallel to the longitudinal axis of the bow and since the spaces between the pairs of apertures 132 extend in a direction perpendicular to the longitudinal axis of the bow, the lateral adjustment afforded by the pairs of apertures 32 is such as to enable the archer's wrist to be positioned either closer to or farther from the path of movement that will be followed by the bow string upon release of an arrow. This allows the archer to adjust the lateral location of the hand grip 42 to suit his shooting style.

Adapted to be fitted to the side bars 48 by means of rods 136 and 137 is a wrist cushion 142. The wrist cushion can be seen to comprise a plate 134 to one side of which is affixed a cushioning pad 138. The rods 136 and 137 are rigidly fixed to the plate 134. The rod 137 has a pivoted keeper 135 for locking the rod 137 along with the rod 136 and plate 134 in any selected pair of the apertures 50 in the side bars 48 of the hand grip frame 46. The wrist cushion assembly is optional and may be omitted from the described archery bow assembly without adversely affecting the remaining components of the assembly.

In considering the operation of the described mechanism, it should be noted that the mounting block 88, when mounted at a selected position as will be described, will be fixedly attached to the slideway 112 and thus fixedly attached to the bow's riser 12. The bias spring 92 will have biased the piston 94 as close to the closed end of the mounting block 88 as will be permitted by the length of the piston rod 82. This bias from the return spring 92 firmly seats the triangular keys 110 and snubbers 111 in the key slots 74. Accordingly, unless the bow string is drawn, the hand grip 42 is so immovably connected to the bow riser 12 that the entire bow 10 including the grip 42 have the "feel" of a one-piece assembly.

It is helpful to consider that the bow defines a longitudinal axis for the described bow assembly. Adjustment of the mounting block 88 along the slideway 112 is thus an adjustment of the hand grip attachment assembly comprising inter alia the dampener assembly, the ball and socket joint and the frame 46 contaning the hand grip 42, parallel to the longitudinal axis of the bow. The piston rod 82 is restricted to movement along a second axis which is perpendicular to the longitudinal axis of the bow. The movement of the piston 94 relative to the mounting block 88 is thus a movement along this second axis and the ball and socket joint can be said to be disposed on this second axis when its freedom of movement has been restricted by inter-engagement of the slot and key elements. The adjustment afforded the guide member 52 is a movement parallel to the longitudinal axis of the bow. It can be also noted that the longitudinal axis of the bow and the second axis along which the piston 94 moves define a plane. The adjustment afforded the hand grip 42 by reason of the apertures 132 is then an adjustment involving the movement of the hand grip perpendicular to the plane defined by the longitudinal bow axis and the second axis along which the piston 94 moves.

Assuming the archer has engaged an arrow 140, which may be rested on an arrow rest 144, to the bow string in conventional fashion preparatory to aiming and discharging the arrow, his natural procedure will be to engage the hand grip 42 in the web between his left thumb and forefinger without ordinarily wrapping his left fingers about the hand grip and to point the arrow 140 by right-hand movements in the general direction of his intended target as he retracts his right arm, thus accumulating an arrow shooting energy in the position generally indicated in FIG. 1. This energy is accumulated primarily in the limbs 14 and 16 and the accumulation of such energy requires that the archer firmly brace the bow 10 by means of a secure pressure by his left hand on the grip 42 as the left arm is held substantially stiff or rigid. The retraction of the bow string at this time generates a force acting to draw or pull the riser 12 away from the hand grip 42, which force is opposed in the opposite direction by the stiffness of the archer's left arm, this left arm opposition being indicated by the arrow 148 in FIG. 4.

The action of this opposition force is to restrain the hand grip 42 while the archer pulls on the bow string. The characteristics of bias spring 92 are so selected that it is overcome by the forces acting on the hand grip 42 and the bow 10 while the bow string is being drawn to permit the mounting block 88 to be drawn away from the hand grip and thus permit the mounting block 88 to be drawn to the right as it appears in FIGS. 3 and 4. The triangular keys 110 being mounted on the block 88, are likewise moved away from the slot member 68, thus freeing the hand grip 42 for limited movements in all directions relative to the ball element 80. This limited, although universal freedom of movement, allows the archer, who will be aiming his arrow from the left side of the riser 12 as it appears in FIG. 1, to adjust the direction of his aim without encountering resistance from his firm left hand pressure on the hand grip 42. After the bow string is drawn, the valve 100, due to its resiliency, immediately returns to a position abutting the face of the piston 94 thereupon closing the vents 98. For this purpose, the valve 100 is preferably made from synthetic rubber sheet or the like resilient material. A sheet comprising 0.030" neoprene has been found satisfactory.

Having adjusted his aim, the archer may shoot the arrow by releasing the bow string. As the arrow 140 is discharged, the inertia associated with the described piston and cylinder means and the restriction to flow of hydraulic fluid bathing the piston is initially so great that the arrow 140 commences its flight toward the target before any appreciable motion can have occurred between the hand grip 42 and the riser 12. This assures a flight of the arrow which is accurately representative of the archer's aiming capabilities without unwanted bending or twisting movements that may otherwise be applied by reason of the manner in which the archer engages the hand grip 42.

After inertia of the hydraulic piston and cylinder mechanism has been overcome, the mechanism recovers its original position by a controlled return of the hydraulic fluid through the bypass aperture 106. By controlling the return speed, abrupt relative return movements between the riser 12 and the grip 42 that might adversely affect the manner in which the arrow is discharged, are avoided. The time taken for full return, which is predetermined by the size of the bypass aperture 106, is not critical and may be on the order of one to five seconds.

FIG. 4 illustrates the keys 110 separated by a maximum axial distance from the key slots 74 which is the conditioned extent when the bow string is drawn. Further axial separation between the keys 110 and the key slots 74 is not possible because the coil spring 92 is fully compressed with its adjacent turns abutting one another. As an alternative, a suitable stop (not shown) could be provided to limit the travel of the piston 94. It is preferred that the axial travel afforded the keys 110 at the time the archer draws the string is less than the axial extent of the key slots 74 so that in no event will the keys be fully released from confinement by the key slots. For this purpose, the key slots 74 should be sufficiently deep that, when the keys and slots are partly separated by the drawing of the bow string, ample freedom of movement between the hand grip and the bow is permitted so that the manner in which the archer engages the hand grip will not adversely affect the manner in which the arrow is discharged.

Many archers employ what is referred to as a high grip, this being a grip condition in which the primary force acting between the archer's web and the hand grip is centered on the web, the indicating arrow 148 in FIG. 4 indicating the approximate position along the length of the grip 42 where the archer's thumb-to-finger web will engage the grip 42 for high grip operation. Other archers employ what is referred to as a low grip in which the heel of the left hand is permitted to brace the hand grip along a substantial length of such grip. The hand grip 42, as illustrated particluarly in FIG. 2, is relatively narrow where engaged by an archer using a high grip and is relatively broad where engaged by the heel of the hand of an archer using a low grip.

The rows of side bar apertures 50 are provided to enable an adjustment of the longitudinal axis of the piston rod 82 that passes centrally through the ball and socket joint relative to the point at which the archer engages the hand grip 42. It is believed that most archers, in order to obtain a proper balance of forces acting on the bow limbs, will need to locate such piston rod axis so that it passes through the hand grip 42 slightly below the area of the grip 42 engaged by the archer's hand. Thus, an archer using a high grip will locate the guide member 52 nearer the upper end of the open channel between the bars 48 appearing in FIG. 2. In contrast, an archer employing a low grip will normally lower the guide member 52. Accordingly, the position of guide member 52 is adjustable to suit the preference of the archer, who selects the most desirable alignment between the guide member apertures 54 and the side bar apertures 50, and then preserves such alignment by inserting through the side bar apertures 50 the locking pin 49.

There has been discussed above a longitudinal adjustment of the mounting block 88 along the slideway 112 and also a longitudinal adjustment of the ball and socket joint relative to the hand grip 42. A change in one of these longitudinal adjustments will require a change in the other of these longitudinal adjustments. As an aid to these adjustments, the riser 12 is provided with longitudinally spaced markers 146, which may be paint stripes, between which the hand grip assembly 40 must be located in order to maintain the hand grip 42 properly located between the tips of the bow.

The invention described above enables archers to use a closed hand engaged with a hand grip 42 without adversely affecting the discharge of the arrow. This is an advantage to the archer who has not mastered the opened hand grip and to all archers who, while hunting, may prefer to use a closed hand grip and thus not be concerned with accidentally dropping the bow or with the use of wrist straps. Of course, one may also use an open hand grip as is more commonly used by competitive archers.

Those familiar with the construction of bows will recognize that the illustrated bow assembly described above is intended for use by right-handed archers. A bow assembly for use by left-handed archers embodying the invention would have, as is apparent, an oppositely constructed riser for mounting the hand grip attachment assembly on the opposite side of the bow.

Although the presently preferred embodiment of this invention has been described, it will be understood that various changes may be made within the scope of the appended claims.

Having thus described my invention, I claim:

1. In an archery bow assembly of the type including a bow, means forming a bow string extending between opposite end portions of said bow, a hand grip, and means mounting said hand grip on said bow, the improvement wherein said means mounting said hand grip on said bow includes:

connection means providing for universal movement of said hand grip; and motion restricting means for preventing said universal movement of said hand grip comprising:

first parts fixed in relation to said hand grip and movable with respect to said bow;

second parts fixed in relation to said bow and movable with respect to said hand grip; and bias means for biasing said first parts and said second parts into interengagement with each other, said bias means being constructed and arranged to permit said first parts and said second parts to be disengaged from each other and thereby permit said universal movement of said hand grip in response to forces applied to said hand grip and said bow when said bow string means is drawn in preparation for the shooting of an arrow.

2. The bow assembly of claim 1 wherein said connection means includes a ball element and a socket engaged by said ball element.

3. The bow assembly of claim 2 wherein said first parts and said second parts comprise key members and slot members.

4. The bow assembly of claim 3 wherein said key members and said slot members have generally triangular interfitting parts.

5. The bow assembly of claim 4 wherein said slot members are attached nonrotationally to said hand grip, and said key members are attached nonrotationally to said bow.

6. The bow assembly of claim 1 wherein said connection means further includes dampening means for controlling the speed of return into interengagement of said first parts and said second parts after release of the drawn said bow string means.

7. The bow assembly of claim 6 wherein said connection means comprises a mounting member having a hollow cylinder formed therein, and said dampening means comprises a hydraulic medium in said cylinder and a piston movable within said cylinder.

8. The bow assembly of claim 7 including slideway affixed to said bow and wherein said mounting member has means slidably engaging said slideway.

9. The bow assembly of claim 8 wherein said slideway has a plurality of apertures spaced longitudinally therealong, wherein said mounting member has means forming a socket integral therewith and including a locking pin projecting through said socket means to engage in an aperture of said slideway.

10. The bow assembly of claim 9 including spring means engaging said locking pin for biasing said pin toward said slideway and further including a flange on said locking pin which may be manually engaged for retracting said locking pin from said slideway and which may be moved to hook said mounting member to hold said pin out of engagement with said slideway means.

11. The bow assembly of claim 7 wherein said piston has passages extending therethrough and including valve means for blocking movement of said hydraulic medium through at least one of said passages in the direction of piston movement when said first parts and said second parts are returning into interengagement following release of said bow string means.

12. The bow assembly of claim 1 wherein said connection means includes first and second relatively movable members, means connecting said first relatively movable member to said hand grip, and means connecting said second relatively movable member to said bow.

13. The bow assembly of claim 12 wherein said means connecting said second relatively movable member to said bow comprises a mounting member, supporting said second relatively movable member, a slideway on said bow extending along a portion of the length of said bow, and means to adjustably affix the position of said mounting member on said slideway along a path extending generally longitudinally of said bow.

14. The bow assembly of claim 13 wherein said means connecting said first relatively movable member to said hand grip includes a hand grip mounting frame to which said hand grip is connected, and guide means fixed in relation to said first relatively movable member, said frame and said guide means being constructed and arranged to permit relative movement therebetween along a path generally parallel to the longitudinal axis of said bow, and lock means for preventing relative movement between said guide means and said frame.

15. The bow assembly of claim 14 including markers spaced longitudinally with respect to said slideway for locating said hand grip relative to said slideway.

16. The bow assembly of claim 15 wherein said bow is a compound bow including a riser, said slideway is affixed to said riser, and said markers are disposed longitudinally along said riser.

17. The bow assembly of claim 12, 13, or 14 wherein said first relatively movable member comprises a socket and said second relatively movable member comprises a ball element engaging said socket.

18. The bow assembly of claim 17 wherein said mounting means is provided with a cylindrical cavity enclosing a hydraulic medium, a piston is received within said cavity for movement along the axis thereof, wherein said connection means includes a piston rod connected to said ball element and extending into said cylindrical cavity and moveable with said piston, and wherein said bias means comprises a spring housed within said cavity encircling said piston rod and biasing said piston.

19. An archery bow assembly comprising, in combination, a bow having a longitudinal axis, means forming a bow string attached to said bow, a hand grip, hand grip attachment means connecting said hand grip to said bow in a location spaced from said bow in a direction extending generally along a second axis perpendicular to said longitudinal axis, means for adjusting the position of said hand grip attachment means along said longitudinal axis, and said hand grip attachment means including means for adjusting the position of said hand grip relative to said second axis in a direction generally parallel to said longitudinal axis.

20. The bow assembly of claim 19 further including means for adjusting of the position of said hand grip in a direction perpendicular to a plane containing said longitudinal axis and said second axis.

21. The bow assembly of claim 19 wherein said hand grip attachment means includes a mounting block, and wherein said means for adjusting the position of said hand grip attachment means along said longitudinal axis includes a slideway on said bow, said hand grip attachment means and said bow having interfitting tongue and groove portions allowing sliding movement of said mounting block along said slideway.

22. The bow assembly of claim 19, 20, or 21 wherein said hand grip attachment means includes connection means providing for universal movement of said hand grip.

23. The bow assembly of claim 22 wherein said hand grip attachment means further includes motion restricting means for preventing said universal movement of said hand grip comprising:

first parts fixed in relation to said hand grip and movable with respect to said bow;

second parts fixed in relation to said bow and movable with respect to said hand grip; and bias means for biasing said first parts and said second parts into interengagement with each other, said bias means being constructed and arranged to permit said first parts and said second parts to be disengaged from each other and thereby permit said universal movement in response to forces applied to said hand grip and said bow when said bow string means is drawn in preparation for the shooting of an arrow.

24. In an archery bow assembly of the type including a bow, means forming a bow string extending between opposite end portions of said bow, a hand grip, and means mounting said hand grip on said bow, the improvement wherein said means mounting said hand grip on said bow comprises:

a. a hand grip supporting frame, said hand grip being connected to said supporting frame;

b. a mounting member connected to said bow;

c. hand grip connection means connecting said hand grip supporting frame to said mounting member and providing for universal movement of said hand grip supporting frame relative to said mounting member, said connection means including first and second connecting members movable relative to one another, one of said connecting members being connected in fixed relation to one of said mounting member and said hand grip supporting frame and the other of said connecting members being connected to the other of said mounting member and said hand grip supporting frame for movement along an axis generally perpendicular to said bow;

d. interengageable means comprising parts fixed respectively to said hand grip supporting frame and said mounting member for restricting relative movement of said hand grip supporting frame and said mounting member when said parts are engaged; and e. bias means for moving said other of said connecting members in a direction along said axis to cause said parts of said interengageable means to be mutually engaged and thereby prevent movement of said hand grip supporting frame relative to said bow, said bias means being constructed and arranged to be overcome by the forces exerted on said hand grip and said bow string means as said bow string means is drawn in preparation for shooting an arrow.

25. The bow assembly of claim 24 wherein said one of said connecting members comprises a socket, said mounting means has means providing a cylinder, said other of said connecting members comprises a ball element engaging said socket and connected to a piston rod extending into said cylinder, said mounting means further including a piston on and movable with said piston rod within said cylinder, and said bias means comprises spring means coacting between said piston and a wall of said cylinder.

* * * * *

UNITED STATES PATENT AND TRADEMARK OFFICE

CERTIFICATE OF CORRECTION

PATENT NO. : 4,457,287

DATED : July 3, 1984

INVENTOR(S) : Charles E. Babington

It is certified that error appears in the above-identified patent and that said Letters Patent are hereby corrected as shown below:

Column 2, line 10, "tip" should be ---tips---.

Column 2, line 19, "eccentic" should be --- eccentric---.

Column 2, line 49, "guid" should be --- guide---.

Column 3, line 38, "92" should be ---82---.

Column 3, line 67, "to" should be ---is---.

Column 5, line 22, "32" should be ---132---.

Column 5, line 58, "inter alia" should be ---inter alia---.

Column 10, line 21, the fourth word "of" should be deleted.

Signed and Sealed this

Sixth Day of November 1984

[SEAL]

*Attest:*

GERALD J. MOSSINGHOFF

*Attesting Officer*

*Commissioner of Patents and Trademarks*